United States Patent [19]

Montgomery

[11] 4,292,988

[45] Oct. 6, 1981

[54] SOFT SHOCK PRESSURE PLUG

[75] Inventor: James W. Montgomery, Houston, Tex.

[73] Assignee: Brown Oil Tools, Inc., Houston, Tex.

[21] Appl. No.: 45,988

[22] Filed: Jun. 6, 1979

[51] Int. Cl.[3] ..... F16K 13/04

[52] U.S. Cl. ..... 137/68 R; 166/318

[58] Field of Search ..... 166/317, 318; 137/467, 137/628, 68 R, 625.39

[56] References Cited

U.S. PATENT DOCUMENTS

| | | | |
|---|---|---|---|
| 3,053,322 | 9/1962 | Kline | 166/318 |
| 3,090,442 | 5/1963 | Cochran et al. | 166/318 |
| 3,151,681 | 10/1964 | Cochran | 137/625.39 |
| 3,331,378 | 7/1967 | Gibbs et al. | 137/68 R |
| 3,713,490 | 1/1973 | Watson | 166/318 |
| 3,768,556 | 10/1973 | Baker | 166/318 |
| 4,099,563 | 7/1978 | Hutchisin et al. | 166/317 |
| 4,114,694 | 9/1978 | Dinning | 166/318 |
| 4,188,999 | 2/1980 | Amancharia | 166/317 |

*Primary Examiner*—A. Michael Chambers

*Attorney, Agent, or Firm*—Robert A. Felsman; Margaret E. Anderson

[57] ABSTRACT

The invention comprises a plug assembly for selectively closing and opening a flowway in a tubular conduit. The apparatus includes a seating body having a main passage and adapted to be mounted in the conduit with the main passage in register with the conduit flowway. The seating body defines a seat for receipt of a plug for closing the main passage and supporting a pressure differential across the seat. The apparatus further includes a release control mechanism operative upon the presence of a pressure differential across the seat in excess of a given magnitude to open a bypass passageway bypassing the seat and plug to permit a relatively slow decrease in the pressure differential across the seat.

15 Claims, 9 Drawing Figures

SOFT SHOCK PRESSURE PLUG

BACKGROUND OF THE INVENTION

1. Field of the Invention

In the drilling and production of wells for the recovery of petroleum and other subsurface deposits, it is frequently necessary to close off or plug a tubular conduit, such as a string of tubing extending into the well, at a chosen point along the length of the conduit so that pressure may be built up within the conduit above that point. Subsequently, it is necessary to be able to re-open the conduit for flow therethrough. For example, it is periodically necessary to pack off the annulus between the tubing and a surrounding casing or the like. This is typically done with a packer which is made up into and forms a part of the tubing string. Many such packers are set hydraulically by application of fluid pressure through the tubing. Therefore, a plug apparatus of the type generally described above may be used to permit sufficient pressure to be built up within the tubing to set the packer. Such packers are typically designed so that, once set, they may be held or retained in the set condition without the continued application of fluid pressure through the tubing. Thus, the plug used to close off the tubing during setting of the packer may then be released so that fluid may be circulated through the tubing.

2. Description of the Prior Art

One of the simplest types of plug apparatus for such purposes includes a generally annular seat member which is mounted coaxially within the tubing string by shear pins or the like. When it is desired to close the tubing, a plug is pumped downwardly through the tubing until it is caught on the seat, which is suitably sized and configured to receive it. This closes off the opening through the annular seat member, and thus the tubing conduit, and allows pressure to be built up above the plug. When it is desired to re-open the tubing, the pressure is further increased, shearing the pins mounting the seat member in the tubing and permitting the seat member and plug to be pumped out through the lower end of the tubing. In other devices, the seat may be a permanent part of the tubing string, but the plug may be compressible so that, by increasing the pressure upstream of the plug, it may be pumped through the seat member thereby reopening the latter.

In either of these two types of plug apparatus, the release of the plug and/or seat allows a sudden or extremely rapid decrease of the pressure which had theretofor built up above the plug. This in turn produces a shock wave along the tubing string which may result in various ill effects, including kinking of the tubing, unsetting of a previously set packer, and other types of damage or malfunction in the well apparatus. A similar shock, due to the rapid increase in pressure, occurs below the plug and may damage the formation. Accordingly, it has been desired to develop a plug apparatus which could be released without producing a sudden shock wave.

U.S. Pat. No. 3,090,442, U.S. Pat. No. 3,331,378, and U.S. Pat. No. 4,114,694 all disclose plug assemblies which accomplish this purpose by designs wherein release of the plug apparatus is accomplished by a decrease, rather than an increase, in the pressure being applied to the tubing above the plug. By releasing the pressure gradually in a controlled manner, the aforementioned shock wave can be avoided. However, depending on various factors such as the well conditions, the apparatus being used in the well, etc., the pressure may be inadvertently decreased, as by failure or leakage of some part of the tubing string, pump failure, or the like. Consequently, the plug may be released prematurely, and the cost, both in terms of time and money, of such an accident can be considerable.

Other systems have involved a gradual decrease in pressure at the top of the well in an effort to avoid shock waves. However, this technique does not always result in a sufficient reduction in the downhole pressure differential, i.e. at the plug, to effect the desired result.

SUMMARY OF THE INVENTION

In the present invention, release of the plug apparatus is initiated by an increase, rather than a decrease, in the pressure above the plug. Thus, there is virtually no chance of accidental premature release of the plug. Nevertheless, the apparatus is designed so that the increase in pressure does not immediately release the plug itself nor its seat member, but rather opens a bypass passageway which permits the pressure which has built up above the plug to slowly leak or bleed past the plug and seat so that the pressure differential is decreased gradually. The seat member itself is not released for expulsion from the tubing until the pressure differential has been reduced, by such gradual downhole bleeding, to a low enough magnitude so that release of the seat member, and the consequent near complete elimination of the pressure differential, will not produce a shock wave of dangerous proportions. Thus, the apparatus of the present invention may be referred to as a "soft shock" assembly, as opposed to the devices disclosed in the three prior patents cited above, which may be termed "no shock" assemblies.

More specifically, the apparatus of the present invention includes a mounting body adapted to be adjoined to the tubular conduit in question so as to define a portion of the flowway through said conduit. For example, the mounting body may be a short tubular sub which may be threaded to and form a part of a string of tubing. The apparatus further includes a seating body having a main passage therethrough and defining a seat for receipt of a plug member operative to close the main passage and support a pressure differential across the seat. Lock means interconnect these two bodies and are operative, in a locked position, to releasably mount the seating body on the mounting body with the main passage of the seating body positioned to register with the tubing flowway. The bodies, when so interconnected by the locking means, define bypass passageway means having a relatively small transverse flow area and positioned to permit fluid flow through the flowway bypassing the seat and the plug.

A release control means is operative in a first position with respect to one of the two bodies, preferably the seating body, to close the bypass passageway means and also to maintain the lock means in its locked position. Thus, when the release control means is in its first position, and the plug member is received on the seat, the flowway through the tubing is closed. A connecting means connects the release control means to the seating body in said first position and is releasable upon presence of a pressure differential across the seat, plug member, and bypass passageway means greater than a first magnitude to permit relative movement between the release control means and the seating body to a second position opening the bypass passageway means and freeing the lock means for potential movement from its locked position to an unlocked position to disconnect the mounting and seating bodies.

However, the lock means is adapted to be urged into its locked position upon the presence of a pressure differential across the seat in excess of a second magnitude, and is able to move to its unlocked position only when such pressure differential decreases to the second magnitude. Then, because the second magnitude is less than the first magnitude, the initial increase in pressure upstream of the plug member, which releases the means connecting the release control means to the seating body, permits the pressure differential across the seat to begin decreasing only gradually via the bypass passageway means. Nevertheless, the lock means remains in its locked position, and thus the seating body and plug remain in place in the mounting body, until the pressure differential is decreased to the second magnitude, the latter being chosen so that, when the seating body is finally released, no substantial shock wave will result.

In the preferred embodiments, the mounting body includes internal radial recess means for receipt of the lock means in its locked position, the lock means in turn being resiliently biased radially inwardly toward its unlocked position. The lock means may include a collet assembly, in which the fingers have enlarged free ends for receipt in the recess means of the mounting body. The seating body may then have wedge means for urging the free ends of the collet fingers radially outwardly into the recess means in the presence of the aforementioned pressure differential in excess of the second magnitude. In other embodiments, the lock means may include a plurality of locking dogs having piston means thereon whereby pressure within the tubing may urge them radially outwardly into the recess means in the mounting body. In any event, the release control means preferably comprises a sleeve, coaxial with the seating body, which retains the lock means in its locked position via the seating body by resisting longitudinal movement of the latter from a position in which it radially abuts the lock means to resist their movement out of the recess means.

Accordingly, it is a principal object of the present invention to provide a pressure plug apparatus which may be released by an increase in upstream tubing pressure without producing a substantial shock wave.

Another object of the present invention is to provide such an apparatus wherein an increase in the pressure differential across the plug and its seat opens a bypass passageway past the seat.

Still another object of the present invention is to provide such an apparatus wherein said pressure differential maintains the seating body locked to the mounting body until the pressure differential decreases to a second and substantially lower magnitude.

Still other objects, features, and advantages of the present invention will be made apparent by the following detailed description, the drawings, and the claims.

DESCRIPTION OF THE PREFERRED EMBODIMENTS

Figure 1:
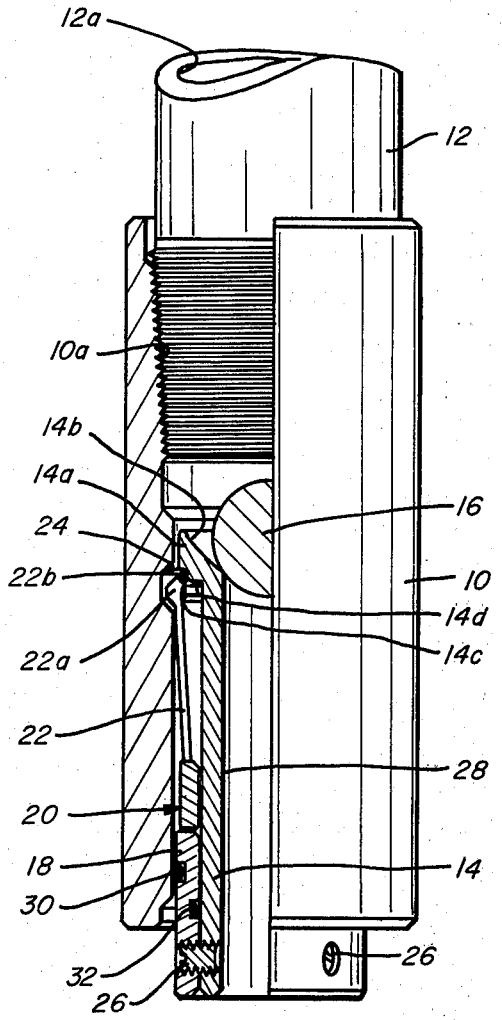
FIG. 1 is a quarter-sectional view of a first embodiment of the invention in fully assembled and locked condition.

Referring first to FIG. 1 there is shown a first embodiment of pressure plug assembly. The apparatus includes an outer generally tubular body or sub 10 which serves as the mounting body for the assembly. The upper end of sub 10 is threaded as indicated at 10*a* so that it may be made up into a string of tubing, the lower end of which is shown at 12. Thus, the central bore of sub 10 becomes a part of the flowway 12*a* defined by the tubing. If needed, the lower end of sub 10 could also be provided with a threaded pin or box for connection of additional tubing sections.

The pressure plug assembly also includes a seating body 14 mounted coaxially within mounting body 10 by means to described more fully below. Seating body 14 is generally annular and has at its upper end a flange 14*a* extending radially outwardly. The radially inner surface 14*b* of the flanged or upper end 14*a* of seating body 14 is downwardly and inwardly tapered to define a seat for a plug member in the form of a ball 16. The radially outer surface of flange 14*a* has a generally cylindrical upper section and a lower beveled section 14*c* which is tapered downwardly and inwardly as shown to join a downwardly facing shoulder 14*d* formed by flange 14*a*.

Interposed between and interconnecting the mounting body 10 and the seating body 14 are release control means, in the form of a control sleeve 18 and lock means, in the form of a collet 20. Control sleeve 18 and collet 20 are both disposed generally within mounting body 10 in coaxially surrounding relation to seating body 14.

Collet 20 includes a solid lower ring and a plurality of fingers 22 extending upwardly therefrom. The upper or free ends 22*a* of collet fingers 22 are enlarged so they extend both radially outwardly and radially inwardly from the lower portions of the fingers 22. Each of these enlarged end portions 22*a* has the upper section 22*b* of its radially inner surface beveled inwardly and downwardly to mate with surface 14*c* of flange 14*a*. Collet fingers 22 are resiliently biased radially inwardly. However, when beveled surfaces 22*b* and 14*c* are longitudinally aligned with each other as shown in FIG. 1, they act as wedge surfaces to force fingers 22 radially outwardly so that the enlarged upper ends 22*a* thereof are received in an internal annular recess 24 in mounting body 10. Such position will be referred herein as the "locked position" of collet 20. The thin lower portions of collet fingers 22 abut sub 10 below recess 24 to limit the extension of enlarged ends 22*a* into the recess. Thus, when the collet fingers 22 are in their locked position, beveled surfaces 22*b* will extend radially inwardly from the inner diameter of mounting body 10 whereby they may support seating body 14 via surfaces 14*c* and prevent downward movement of the seating body. Likewise, as long as surfaces 14*c* are maintained in longitudinal alignment with and radially abutting surfaces 22*b*, collet fingers 22 cannot retract inwardly from their locked position.

In order to prevent such relative longitudinal movement between collet 20 and seating body 14, control sleeve 18 is positioned to abut the lower end of collet 20 when the surfaces 22*b* and 14*c* are aligned. Control sleeve 18 is releasably connected to seating body 14 in this position (which will be referred to herein as its "first position") by a plurality of shear pins 26. Thus, collet assembly 20 is trapped between the upper surface of sleeve 18 and surface 14*c* of seating body 14 preventing relative longitudinal movement between the seating body and the collet. The collet 20, and particularly enlarged upper ends 22*a* of fingers 22, being forced into recess 24 by surfaces 14*c*, support the entire assemblage comprised of collet 20, seating body 14, and control sleeve 18 within the mounting body 10. Accordingly, it may be said that control sleeve 18 maintains collet 20 in its locked position via pins 26 and seating body 14.

As previously mentioned, the central bore of mounting body 10 forms a part of the flowway 12*a* of the tubing string 12. Seating body 14, being annular and being mounted coaxially within mounting body 10, has its central bore 28 in register with said flowway. Thus, bore 28 may be considered the main passage through the plug assembly. When plug member 16 is received on seat 14*b* as shown in FIG. 1, main passage 28 is plugged or sealed off. A bypass passageway is defined by the portion of the annular space between mounting body 10 and seating body 14 which is not occupied by collet 20. This bypass passageway has a transverse flow area substantially less than that of main passage 28. With the apparatus in its fully assembled condition, as shown in FIG. 1, control sleeve 18 seals off the bypass passageway via an O-ring 30 carried on the outer diameter of sleeve 18 and sealing against the inner diameter of mounting body 10 and an O-ring 32 carried on the inner diameter of sleeve 18 and sealing against outer diameter of seating body 14. Thus, with control sleeve 18 in its first position as shown in FIG. 1, a pressure differential can be supported across the bypass passageway defined between bodies 10 and 14. Thus, when it is desired to create a pressure differential across seat 14*b*, or across the plug apparatus in general, so that pressure may be built up in tubing string 12 above the plug assembly, e.g. to set a hydraulic packer or the like, plug member 16 is emplaced in tubing string 12 and pumped downwardly until it is caught on seat 14*b*. Then, upon continued application of pump pressure, the aforementioned pressure differential is built up.

Pins 26 are designed to maintain the connection between control sleeve 18 and seating body 14 when the pressure differential across seat 14*b*, plug 16 and the bypass passageway defined between bodies 10 and 14 remains at or below a first magnitude. This first magnitude is, in turn, chosen so that it will be high enough to permit a sufficient pressure to be built up in tubing 12 upstream of seat 14*b* to perform the necessary function, e.g. setting of a packer. Once that function has been performed, it may be desired to re-open the portion of flowway 12*a* formed by mounting body 10 so that fluid can be circulated through the tubing 12. However, a sudden complete opening of the flowway would result in a mechanical shock wave, which would be transmitted upwardly via the tubing string 12 and could cause damage to the string, unsetting of the packer, or other problems, and a fluid shock wave below the plug which could damage the formation and/or compound the shock wave in the tubing. Accordingly, the plug assembly is designed to permit a relatively slow decrease in the pressure differential across seat 14*b* and plug member 16, but initiated by an increase in such differential.

Figure 2:
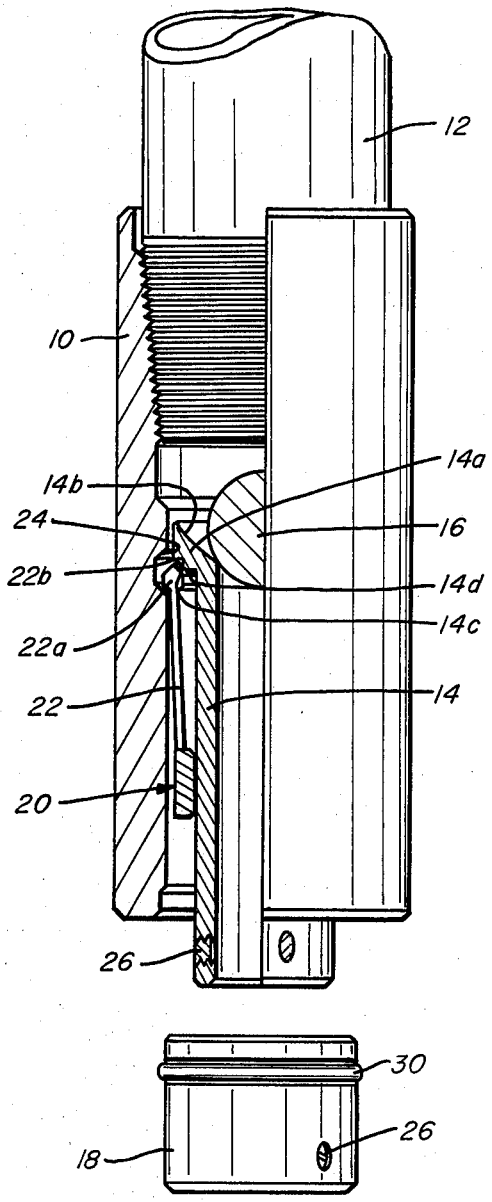
FIG. 2 is a quarter-sectional view of the apparatus of FIG. 1 with the control sleeve separated and the remainder of the apparatus still in locked condition.

In particular, when it is desired to release the plug assembly, the pump pressure being applied to the tubing 12 above the plug assembly is increased so that the differential across the seat, plug, and bypass passageway exceeds the aforementioned first magnitude. Control sleeve 18 will then act as a piston in response to the increased pressure differential across the bypass passageway and will be urged downwardly shearing pins 26 and permitting sleeve 18 to drop downwardly out of mounting body 10 as shown in FIG. 2. Any lowered position of sleeve 18 at which it ceases to abut the lower end of collet 20 and also ceases to seal the bypass passageway will be referred to herein as the "second position" of sleeve 18.

Movement of sleeve 18 to such second position not only opens the bypass passageway but also frees seating body 14 and collet 20 for potential relative longitudinal movement. As previously mentioned, upon such movement, if surface 14*c* is offset upwardly from surface 22*b*, the enlarged upper ends 22*a* of collet fingers 22 may move radially inwardly to a position completely underlying flange 14*a* of the seating body. However, the bypass passageway provided between bodies 10 and 14 has a relatively small transverse flow area. Therefore, opening of this bypass passageway by release of sleeve 18 merely permits a relatively slow leakage or bleeding of fluid through the bypass passageway bypassing seat 14*b* and plug member 16. Thus, the pressure differential across seat 14*b* plug member 16 is decreased only gradually.

Figure 3:
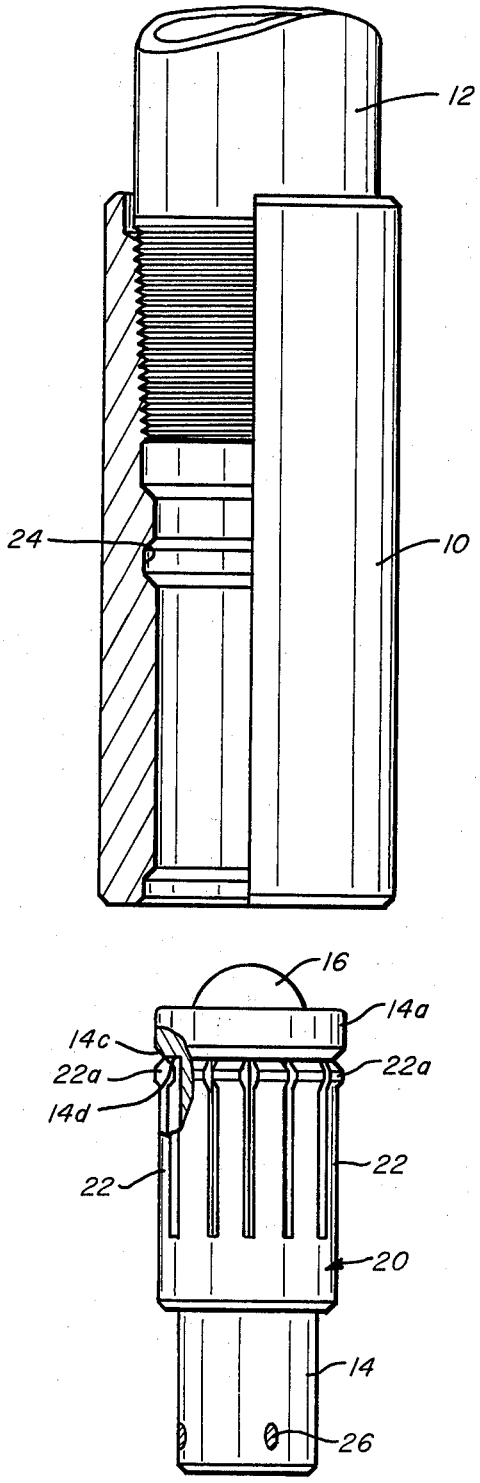
FIG. 3 is a partial sectional and partial elevational view of the apparatus of FIGS. 1 and 2 in unlocked condition and with the plug and seating body separated from the mounting body.

Such pressure differential will exert a downward force on plug member 16 and seating body 14, thus continuing to urge the collet fingers 22 radially outwardly into their locked position via wedge surfaces 14*c* and 22*b*. Only after the pressure differential across seat 14*b* and plug member 16 decreases to a second magnitude, substantially less than the aforementioned first magnitude required to shear pins 26, will the resilient biasing force of collet fingers 22 be sufficient to overcome this wedging action. When such second magnitude is reached, collet fingers 22 can move radially inwardly under their resilient biasing force camming seating body 14 upwardly via surfaces 22*b* and 14*c* so that the enlarged upper ends 22*a* of fingers 22 may move out of recess 24 and under flange 14*a* as shown in FIG. 3. At this point, collet 20 is in its unlocked position and is freed to move downwardly, along with seating body 14 and plug member 16, and out of mounting body 10 as shown in FIG. 3. However, by this time the pressure differential across seat 14*b* and plug member 16 will have been reduced to a sufficient degree so that the sudden opening of the full bore of mounting body 10 will not produce a shock wave sufficient to cause any substantial damage or malfunctioning of the apparatus thereabove. For this reason, the plug assembly of the invention is referred to as a "soft shock" assembly.

Figure 4:
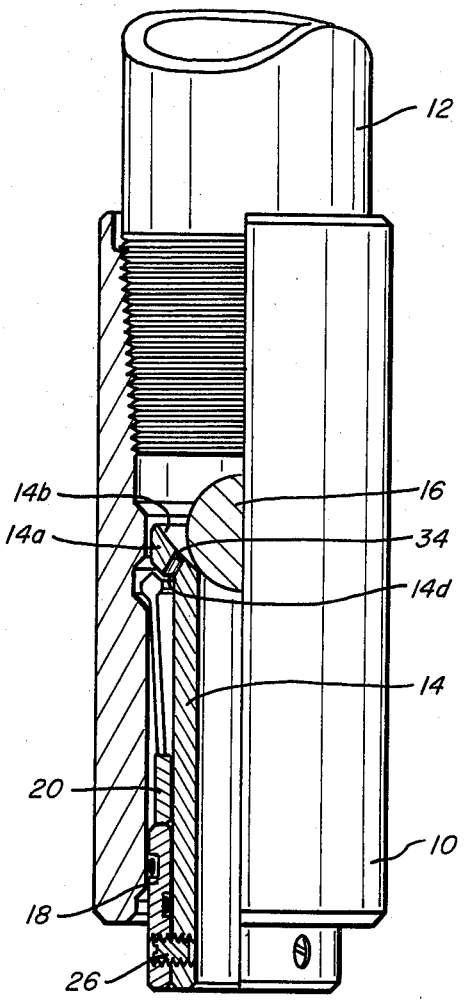
FIG. 4 is a quarter-sectional view of a modified form of the apparatus of FIG. 1.

Referring to FIG. 2, it will be apparent that, after release of sleeve 18, the gradual bypassing of fluid past seat 14*b* and plug member 16 must be by leakage around the exterior of seating body 14. In FIG. 4 there is shown a modified version of the apparatus of FIGS. 1–3 in which the flange 14*a* of seating body 14 is provided with a plurality of bores therethrough, one of which is shown at 34. Each such bore extends from an upper point located radially outwardly of the contact point of seat 14*b* with plug member 16 downwardly and outwardly through shoulder 14. Such bores become a part of the bypass passageway and facilitate leakage of fluid therethrough once it has been opened by release of control sleeve 18. The size and number of bores 34 can be varied to control the leakage rate as desired. Otherwise, the apparatus of FIG. 4 is substantially identical to that of FIGS. 1–3, and like parts have been given like reference numerals.

Figure 5:
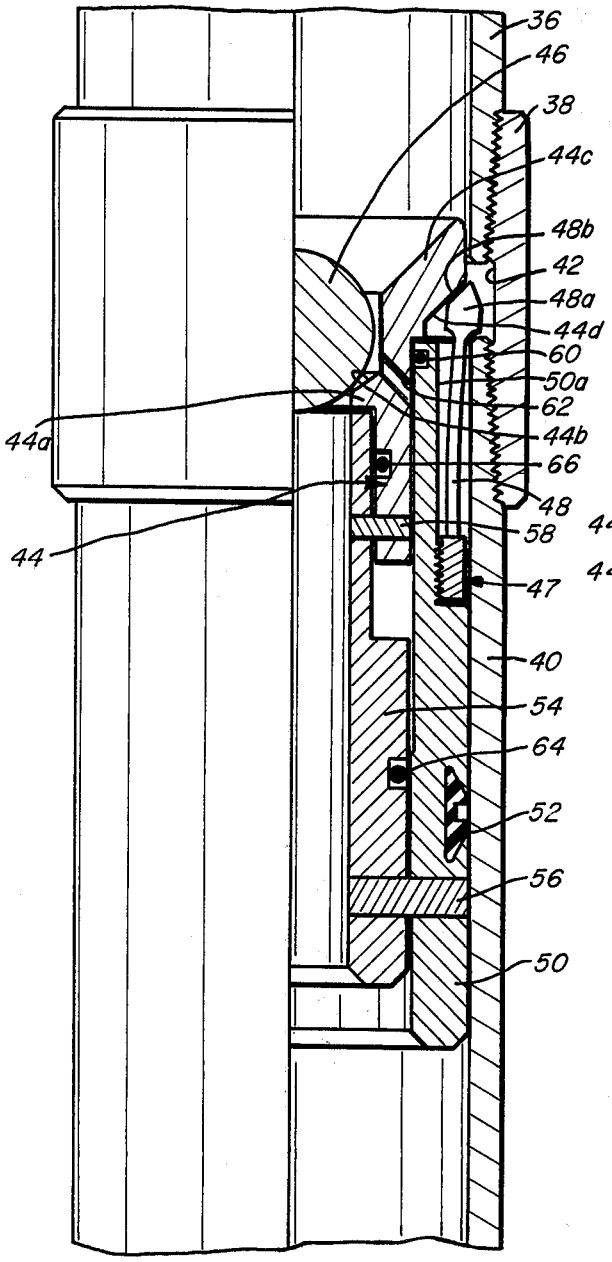
FIG. 5 is a quarter-sectional view of a second embodiment of the invention in fully assembled and locked condition.
Figure 6:
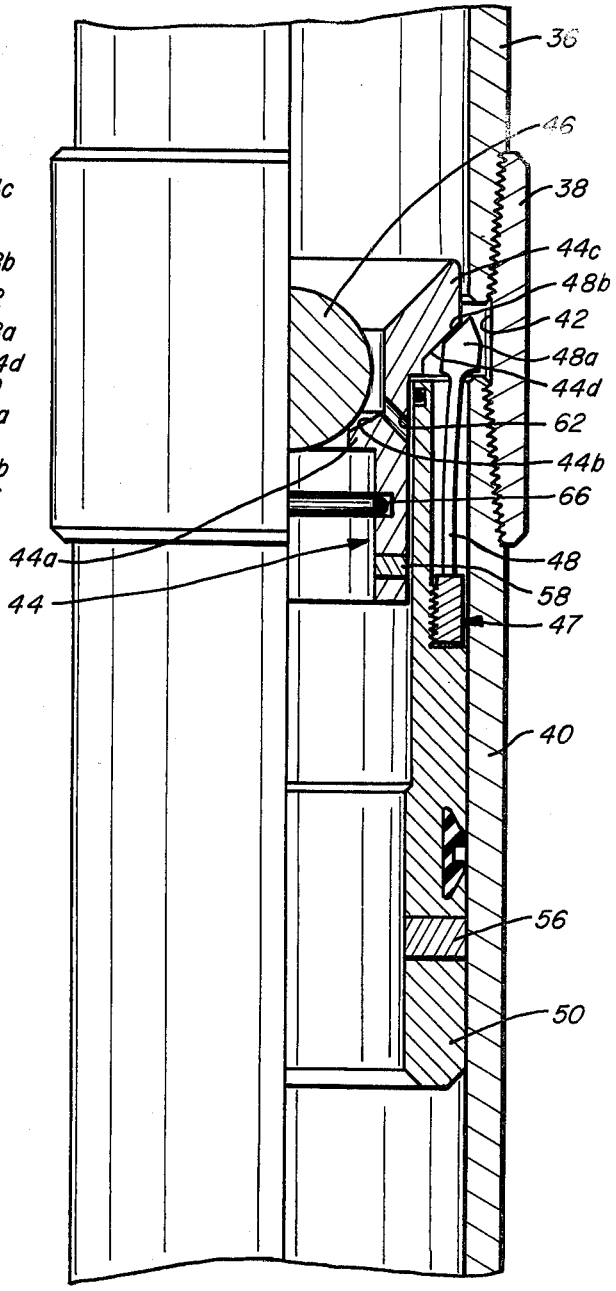
FIG. 6 is a quarter-sectional view of the apparatus of FIG. 5 with the control sleeve removed and the remainder of the apparatus still in locked condition.
Figure 7:
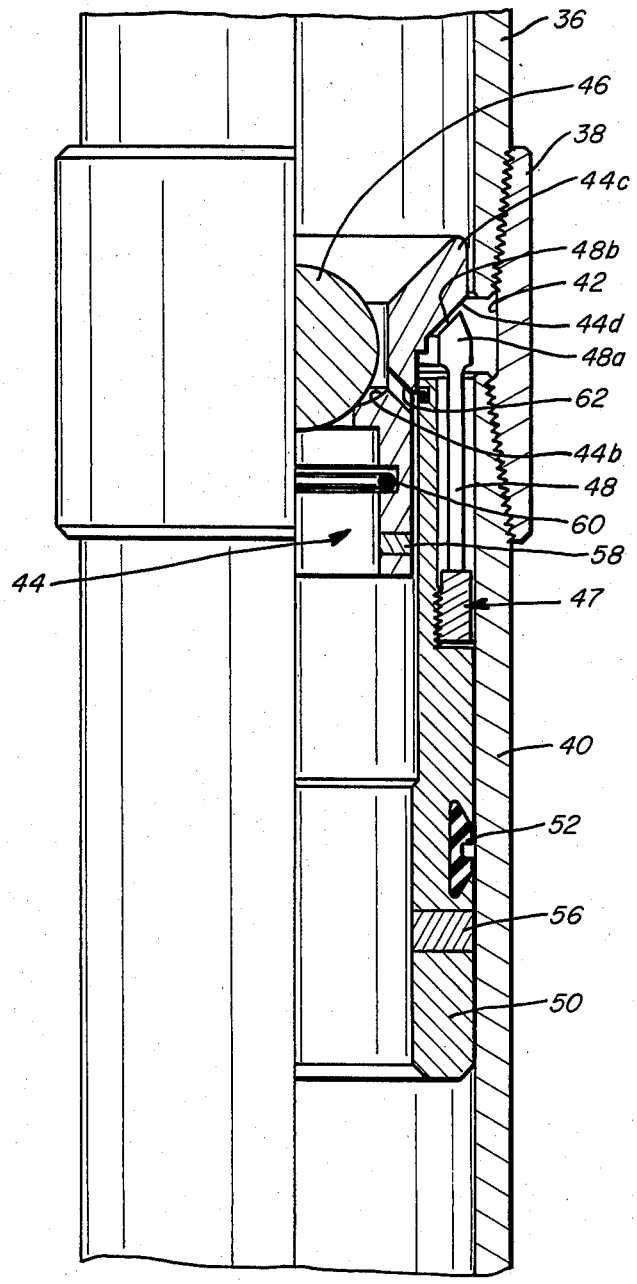
FIG. 7 is a quarter-sectional view of the apparatus of FIGS. 5 and 6 in unlocked condition.

Referring now to FIGS. 5–7 there is shown a second embodiment of the invention. FIG. 5 shows the apparatus in its fully assembled and locked condition. In this embodiment, the lower end of a section of tubing 36 is threadedly connected to the upper end of collar 38, which in turn has its lower end threadedly connected to the upper end of another section of tubing 40. Members 36, 38, and 40, as connected, may be considered the mounting body of the second embodiment of the invention. It can be seen that the opposed ends of tubing sections 36 and 40 are longitudinally spaced apart by collar 38 whereby, with that collar, they define an intenral annular recess 42 in the mounting body.

The assembly also includes a generally annular seating body 44. Seating body 44 includes a generally cylindrical or sleeve like main portion. Intermediate the ends of this generally cylindrical portion, is an annular flange 44*a* which extends radially inwardly to define a seat 44*b* for plug member 46. At the upper end of the generally cylindrical main portion of seating body 44 is another annular flange 44*c* inclined inwardly and radially outwardly from the main portion of the seating body. Flange 44*c* thus defines a similarly inclined surface 44*d* facing generally radially outwardly and downwardly and which serves as a wedge surface for cooperation with the lock means in a manner to be described more fully below.

The lock means is disposed coaxially within the mounting body 36, 38, 40 and partially surrounds the seating body 44. The lock means includes a collet 47 including a lower ring and a plurality of fingers 48 extending outwardly therefrom. The lock means further comprises a carrier sleeve 50 the lower portion of which has a sliding fit within tubing section 40 and is sealed with respect thereto by a seal 52. The upper portion of carrier sleeve 50 has a reduced outer diameter, as indicated at 50*a*, to define an annular space between tubing section 40 and carrier sleeve 50 for receipt of collet 47. The lower ring portion of collet 47 is threaded to the lower end of reduced diameter section 50*a* of carrier sleeve 50.

The upper or free ends of collet fingers 48 are enlarged as indicated at 48*a* so that they extend radially both outwardly and inwardly with respect to the thin lower or main portions of the collet fingers. Thus, enlarged end portions 48*a* can be engaged in the annular recess 42 of the mounting body, as shown in FIG. 5, and when so engaged, support the lock means 47, 50 on the mounting body. The uppermost portion of each finger end 48*a* has its radially inner surface downwardly and inwardly inclined at 48*b* to mate with surface 44*d* of the seating body flange 44*c*. Engagement of the upper edge of tubing section 40 with the lower or thin-sectioned portion of collet finger 48 limits the extent to which enlarged end portion 48*a* of the collet finger may be urged into recess 42 so that surface 48*b* always extends radially inwardly from the inner diameter of tubing sections 36 and 40 whereby it may engage and support the seating body 44 via surface 44*d*.

Surfaces 48*b* and 44*d* also coact as wedge surfaces to urge the collet fingers 48, which are biased radially inwardly, outwardly into their locked position wherein they are engaged in recess 42 as shown in FIG. 5. As long as the uppermost portion of surface 44*d* remains longitudinally aligned with and radially abutting surface 48*b*, collet fingers 48 are prevented from moving radially inwardly from their locked position. Thus, the lock means 47, 50 remain supported in the mounted body via enlarged finger ends 48*a*, and seating body 44 in turn remains supported on surfaces 48*b*. However, if relative longitudinal movement between seating body 44 and lock means 47, 50 is permitted, and more particularly, if seating body 44 is permitted to move upwardly relative to lock means 47, 50, the ends 48*a* of collet fingers 48 are permitted to move radially inwardly out of recess 42 and further under flange 44 to release the lock means and seating body from the mounting body.

In order to prevent such relative longitudinal movement of the seating body and lock means, and thus to maintain the lock means in its locked position, there is provided a release control sleeve 54. Sleeve 54 is coaxial with sleeve 50 and seating body 44. Control sleeve 54 has an enlarged lower portion having a sliding fit within sleeve 50 and an upper portion of smaller outer diameter having a sliding fit within the lower portion of seating body 44. Sleeve 54 is releasably connected to sleeve 50 by a first set of shear pins 56 and to seating body 44 by a second set of shear pins 58 thereby fixing the seating body 44 to the lock means 47, 50, with the latter retained in its locked position via wedge surfaces 44*d* as explained hereinabove. This position of control sleeve 54, as shown in FIG. 5, will be referred to as its "first position".

It can be seen that, when plug member 46 is seated on seat 44*b*, it closes the main passage or central bore of the seating body 44 preventing fluid flow therethrough. As previously mentioned, carrier sleeve 50 of the lock means is sealed against the inner diameter of the mounting body by seal 52 thereby preventing fluid from bypassing seat 44*b* and plug member 46 by leaking around the exterior of the lock means. Carrier sleeve 50 also carries an O-ring 60 near its upper end which seals against the outer diameter of seating body 44. Thus, fluid is also prevented from bypassing seat 44*b* and plug member 46 by leaking around the exterior of the lock means. However, a plurality of bores 62 each extend through seating body 44 from an inner end point located laterally outwardly of the contact area between plug member 46 and seat 44*b* to an outer end communicating with the annular space between body 44 and sleeve 50 below seal 60. Thus, the latter annular space together with bores 62 defines a bypass passageway bypassing plug 46 and seat 44*b*.

When the release control sleeve 54 is in its first position as shown in FIG. 5., it serves to close the bypass passageway since it is sealed against the inner diameter of sleeve 50 below port 62 by an O-ring 64 carried on the exterior of sleeve 54, and is also sealed against the inner diameter of seating body 44 below port 62 by an O-ring 66 carried on the interior of seating body 44. Thus, with the release control sleeve in its first position, and the plug member 46 in place on seat 44*b*, a pressure differential may be supported across the plug assembly within the tubing string of which it forms a part, and more specifically, across seat 44*b*, plug 46, and the bypass passageway. Accordingly, pressure may be built up above the plug assembly to set a hydraulic packer or perform any other desired function, and such pressure can be maintained as long as the aforementioned differential remains at or below a first magnitude.

After performing of the desired operation, e.g. setting of a packer, when it is desired to re-open the tubing for fluid flow therethrough, the pressure above the plug assembly is increased so that the differential across the plug assembly exceeds the aforementioned first magnitude. This will cause shear pins 58 and 56 to shear allowing release control sleeve 54 to drop out through the lower end of the tubing string. Any lowered position of sleeve 54 in which it no longer interconnects body 44 and sleeve 50 nor seals off the annular space between those two members, will be referred to as the "second position" of the release control sleeve.

FIG. 6 shows the apparatus just after such release of the control sleeve 54 and opening of the bypass passageway. The transverse flow area of such passageway, and more specifically, of ports 62 is so small that, upon release of control sleeve 54, only a slow decrease in the pressure differential across plug member 46 and seat 44*b* is permitted by leakage of fluid through the bypass passageway. Until this differential is reduced to a second magnitude, substantially less than the first magnitude required to shear pins 58 and 56, a downward force is exerted on plug member 46 and seating body 44, by virtue of the pressure differential, sufficient to overcome the resilient bias of collet fingers 48 and continue to urge the latter into their locked position via wedge surfaces 44*d* and 48*b* as shown in FIG. 6. When the pressure differential across the seat 44*b* and plug member 46 reaches the second magnitude, the resilient bias of collet fingers 48 will be sufficient to overcome the downward force exerted on the seating body by the pressure differential, and collet fingers 48 will move radially out of recess 42 and further under flange 44*c*, simultaneously camming the seating body 44 upwardly via surfaces 48*b* and 44*d* to the position shown in FIG. 7. The lock means is then in its unlocked position wherein the entire assemblage comprising lock means 47, 50 seating body 44, and plug member 46 may drop or be pumped out through the lower end of the tubing string opening the full bore thereof for fluid flow. However, by this time, the pressure differential across the seat and plug member will have been reduced to a sufficiently low magnitude such that no substantial shock wave will be produced by such opening of the full bore of the tubing.

Figure 8:
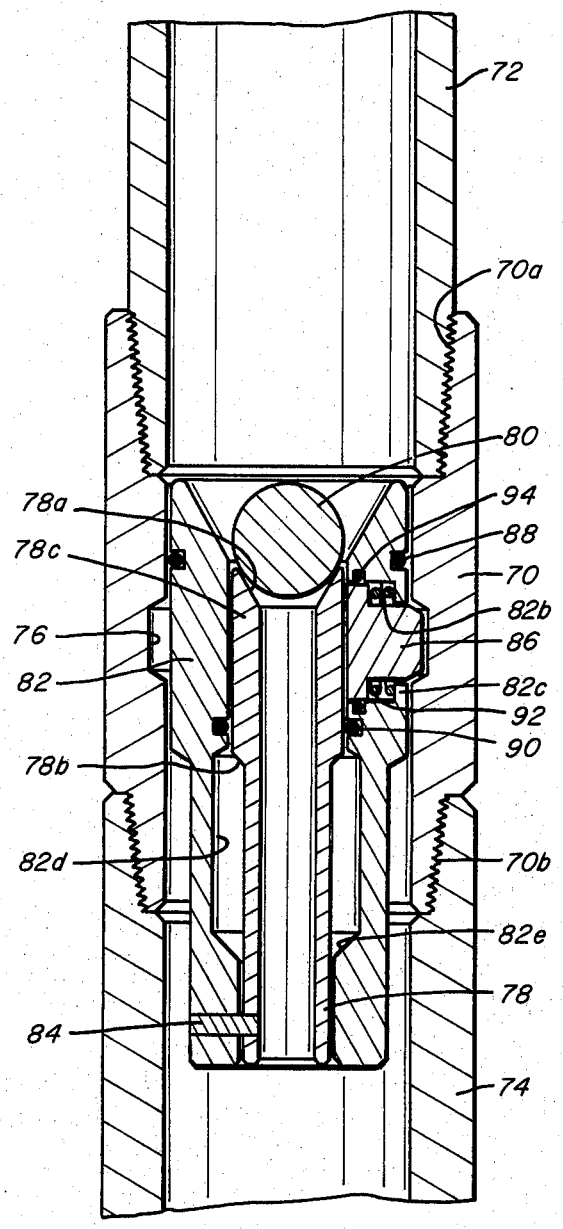
FIG. 8 is a cross-sectional view of a third embodiment of the invention in fully assembled and locked condition.
Figure 9:
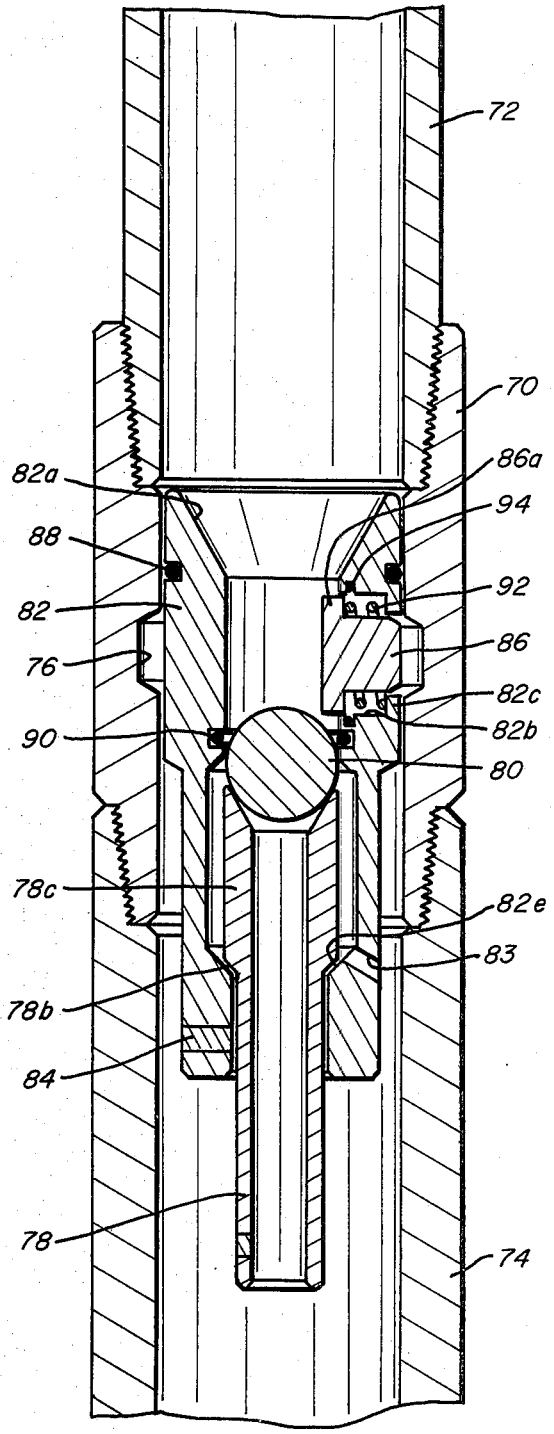
FIG. 9 is a cross-sectional view of the apparatus of FIG. 8 in unlocked condition.

Referring now to FIGS. 8 and 9, there is shown a third embodiment of the invention. The mounting body of the assemblage of FIGS. 8 and 9 is formed by a sub 70 having at its upper end a threaded box 70*a* for connection to the lower end of a string 72 of tubing of which sub 70 forms a part. At the lower end of sub 70 is a threaded pin 70*b* for connection of the plug assembly to additional tubing sections such as 74. Sub 70 also has an internal annular recess 76 intermediate its ends. An annular seating body 78 is coaxially mounted within sub 70 in a manner to be described more fully below so that its bore forms a main flow passage for the assembly in register with the flowway of the tubing string 72. The upper end of seating body 78 is downwardly and inwardly tapered to define a seat 78*a* for a plug member 80. The outer diameter of seating body 78 is reduced along the lower portion thereof so as to define an external annular generally downwardly facing shoulder 78*b*.

Seating body 78 is mounted coaxially within a release control sleeve 82 by a plurality of shear pins 84, and the control sleeve 82 is, in turn, supported in the mounting body or sub 70 by lock means in the form of a plurality of dogs 86 adapted to be received in recess 76. Control sleeve 82 has a relatively thick-walled upper portion having a sliding fit with sub 70 as well as with the upper or large diameter portion of seating body 78. This thick upper portion is sealed against the interior of sub 70 by an O-ring 88 carried in the exterior of the upper or thick-walled portion of the control sleeve 82, and is also sealed against the exterior of the large diameter portion of seating body 78 by an O-ring 90 carried on the interior of the thick-walled portion of sleeve 82. The upper end 82*a* of control sleeve 82 is downwardly and inwardly tapered to guide plug member 80 onto seat 78*a*.

The thick-walled or upper portion of sleeve 82 has a plurality of radial bores 82*b* therethrough in each of which one of the locking dogs 86 is mounted for radial reciprocation. A respective annular flange 82*c* formed on sleeve 82 extends radially inwardly with respect to each of the bores 82*b* adjacent its outer extremity. Each of the locking dogs 86 has an annular flange 86*a* extending radially outwardly from the inner end thereof for sliding contact with the respective bore 82*b*. Each dog 86 is surrounded by a compression spring 92 which bears against flanges 82*c* and 86*a* to bias the dog 86 radially inwardly. However, when the seating body 78 is connected to the control sleeve 82 with the large diameter portion of the former in alignment with the dogs 86, the outer surface 78*c* of the large diameter portion of seating body 78 abuts the inner surfaces of dogs 86 to urge them radially outwardly against the bias of springs 92 and into the recess 76. Thus, sleeve 82 is supported in mounting body 70 via dogs 86, and seating body 78 is in turn supported on sleeve 82 by shear pins 84. As long as surface 78*c* remains in alignment with dogs 86, the latter are maintained in their locked position in recess 76 as shown in FIG. 8. Thus, control sleeve 82 may be said to retain the locking dogs 86 in their locked position via shear pins 84 and seating body 78. The position of sleeve 82 relatively to seating body 78 in which surface 78*c* is aligned with dogs 86, as shown in FIG. 8, will be referred to as the "first position" of sleeve 82.

The annular space between seating body 78 and control sleeve 82 forms a bypass passageway whereby fluid may bypass seat 78*a* and plug member 80. This passageway is enlarged by an internal annular recess 82*d* in sleeve 82 below O-ring 90, which recess also defines a generally upwardly facing shoulder 82*e*. It can be seen that, when the control sleeve 82 is in its first position relative to seating body 78, the bypass passageway is closed by O-ring 90 sealing between the thick upper portion of sleeve 82 and the large diameter upper portion of seating body 78.

With the apparatus in the fully assembled and locked position shown in FIG. 8, and with the plug member 80 properly seated on seat 78*a*, pressure may be built up above the plug assembly to create a pressure differential thereacross. The pressure built above the plug assembly may be used to set a hydraulic packer or for any other desired purpose. After such purpose has been accomplished, and when it is desired to re-open the portion of the tubing flowway defined by sub 70, the pressure above the plug assembly is increased, thereby increasing the pressure differential across seat 78*a*, plug member 80, and the bypass passageway until such differential exceeds a first magnitude sufficient to shear pins 84. This permits seating body 78 to drop downwardly within control sleeve 82 until shoulder 78*b* seats on shoulder 82*e*. The control sleeve 82 is then said to be in a "second position" relative to seating body 78, in which the large diameter abutment surface 78*c* of seating body 78 has been longitudinally displaced from alignment with dogs 86, and the bypass passageway has been opened by disengagement of surface 78*c* from seal 90. Generally radial ports 83 may be provided through sleeve 82 above the point of contact with body 78 to prevent an effective seal being formed between sleeve 82 and body 78 at shoulder 82*e*.

The transverse flow area provided by the bypass passageway defined between seating body 78 and control sleeve 82 is sufficiently small that, when opened, it permits only a gradual decrease in the pressure differential across seat 78*a* and plug member 80 by relatively slow leakage of fluid through the bypass passageway. The flanges 86*a* of dogs 86 are sealed with respect to the bores 82*b* in which they are carried by means of respective O-rings 94. Thus, flanges 86*a* may act as pistons on the locking dogs 86. After pins 84 have been sheared and seating body 78 has dropped downwardly as described above, the pressure prevailing above seat 78*a* and plug member 70 will act against the inner surfaces of pistons 86*a* tending to urge the locking dogs radially outwardly. The pressure prevailing below seat 78*a* and plug member 80 may be communicated to the outer sides of pistons 86*a* through the space between sleeve 92 and sub 70 below seal 888. Since, immediately after shearing of pins 84 a substantial pressure differential still exits across seat 78 and plug member 80, the fluid pressure within the apparatus above plug member 80 and adjacent to dogs 86 will act upon pistons 86*a* to retain dogs 86 in their locked position. Only after the pressure within the tubing adjacent dogs 86, or the pressure differential across seat 78*a* and plug member 80, has been reduced to a second magnitude substantially less than the first magnitude required to shear pins 84, will the force of springs 92 be able to overcome such fluid pressure and urge the locking dogs radially inwardly and out of recess 76 to their unlocked position, shown in FIG. 9. At this point, the entire assemblage including sleeve 82, dogs 86, seating body 78, and plug member 80 is free to drop or be pumped out of the bottom of the tubing string. However, the aforementioned second magnitude is chosen such that no substantial shock wave will be produced when the bore of sub 70 is thereby opened for full fluid communication.

Other embodiments of the present invention, as well as numerous modifications of the preferred embodiment described hereinabove, may suggest themselves to those of skill in the art. Accordingly, it is intended that the scope of the present invention be limited only by the claims which follow.

I claim:

1. Releasable closure apparatus for selectively closing and opening a flowway in a tubular conduit comprising:

a seating body having a main passage therethrough and adapted to be mounted in said tubular conduit with said main passage in register with said flowway, said seating body defining a seat for receipt of a plug member operative to close said main passage and support a pressure differential across said seat;

release control means releasably connected to one of said seating body or said tubular conduit and releasable upon the presence of a pressure differential across said seat in excess of a first magnitude to open bypass passageway means bypassing said seat to permit a relatively slow decrease in said pressure differential;

and lack means releasably locking said seating body to said tubular conduit, said lock means being releasable upon decrease of said pressure differential to a second magnitude to release said seating body from said tubular conduit.

2. Releasable closure apparatus for selectively closing and opening a flowway in a tubular conduit comprising:

a mounting body adapted to be adjoined to said tubular conduit and to define a portion of the flowway thereof;

a seating body having a main passage therethrough and defining a seat for receipt of a plug member operative to close said main passage and support a pressure differential across said seat;

lock means interconnecting said bodies and operative in a locked position to releasably mount said seating body on said mounting body with said main passage positioned to register with the flowway of said tubular conduit, said bodies, when so interconnected by said lock means, defining bypass passageway means positioned to permit fluid flow through said flowway bypassing said seat and said plug;

release control means operative in a first position with respect to one of said bodies to close said bypass passageway means and to maintain said lock means in said locked position, whereby, when said release control means is in said first position, and said plug member is received on said seat, said flowway may be closed;

connecting means connecting said release control means to said one of said bodies in said first position and releasable upon presence of a pressure differential across said bypass passageway means greater than a first magnitude to permit relative movement between said release control means and said one of said bodies to a second position opening said bypass passageway means and freeing said lock means for potential movement from said locked position to an unlocked position to disconnect said bodies.

3. The apparatus of claim 2 wherein said lock means is adapted to be urged into said locked position upon the presence of pressure differential across said seat in excess of a second magnitude less than said just magnitude, and to permit movement of said lock means to said unlocked position in the absence of a pressure differential across said seat in excess of said second magnitude.

4. The apparatus of claim 3 wherein the transverse flow area of said main passage is substantially greater than the transverse flow area of said bypass passageway means.

5. The apparatus of claim 3 wherein said lock means is resiliently biased toward said unlocked position.

6. The apparatus of claim 5 wherein said one of said bodies in said seating body, and wherein said mounting body comprises a generally tubular body having internal radial recess means for receipt of said lock means in said locked position.

7. The apparatus of claim 6 wherein said lock means comprises a collet including a plurality of fingers having enlarged free ends for receipt in said recess means of said mounting body in said locked position.

8. The apparatus of claim 7 wherein said seating body and said collet have wedge means operatively associated to urge said enlarged free ends radially outwardly into said recess means of said mounting body upon presence of a pressure differential across said seat in excess of said second magnitude.

9. The apparatus of claim 8 wherein said bypass passageway mean includes port means extending generally laterally through said seating body.

10. The apparatus of claim 6 wherein said lock means comprises a plurality of locking dogs mounted for radial reciprocation into and out of said recess mean and each having piston means thereon operative, upon presence of a sufficient pressure in said flowway adjacent said piston means, to urge said locking dogs radially outwardly into said recess means.

11. The apparatus of claim 10 wherein said release control means comprises a sleeve generally surrounding said seating body in said first position, and wherein said locking dogs are mounted in said sleeve.

12. The apparatus of claim 11 wherein said seating body has abutment surface means which, in said first position, is longitudinally aligned with and abuttable with said locking dogs to retain said locking dogs in said locked position, and in said second position, is longitudinally offset from said locking dogs.

13. The apparatus of claim 6 wherein said one body in said seating body, said seating body having abutment surfaces which, in said first position, are held, via said release control means, radially opposed to said lock means and abutable therewith to resist radially inward movement of said lock means from said locked position to said unlocked position, release of said connecting means being operative to free said seating body for longitudinal movement of said abutment surfaces with respect to said lock means.

14. The apparatus of claim 13 wherein said abutment surfaces also serve as wedge surfaces operative to urge said lock means radially outwardly into said recess means of said mounting body upon the presence of a pressure differential across said seat in excess of said second magnitude.

15. The apparatus of claim 13 wherein said release control means comprises a generally annular member, and said connecting means comprises shear means.

* * * * *